US007247487B2

(12) United States Patent
Jacobs et al.

(10) Patent No.: US 7,247,487 B2
(45) Date of Patent: Jul. 24, 2007

(54) REDUCING WORKING FLUID DILUTION IN LIQUID SYSTEMS

(75) Inventors: Merrit Jacobs, Fairport, NY (US); Zhong Ding, Fairport, NY (US)

(73) Assignee: Ortho-Clinical Diagnostics, Raritan, NJ (US)

( * ) Notice: Subject to any disclaimer, the term of this patent is extended or adjusted under 35 U.S.C. 154(b) by 372 days.

(21) Appl. No.: 10/464,156

(22) Filed: Jun. 18, 2003

(65) Prior Publication Data

US 2004/0259268 A1 Dec. 23, 2004

(51) Int. Cl.

| | |
|---|---|
| ***G01N 35/08*** | (2006.01) |
| ***G01N 35/00*** | (2006.01) |
| ***G01N 1/00*** | (2006.01) |
| ***G01N 1/10*** | (2006.01) |
| ***G01N 21/00*** | (2006.01) |

(52) U.S. Cl. ..... 436/53; 422/50; 422/81; 422/82; 422/100; 422/103; 436/43; 436/54; 436/174; 436/180; 137/1

(58) Field of Classification Search ..... 422/81, 422/82, 100, 103, 50; 436/43, 53, 54, 174, 436/180; 137/1

See application file for complete search history.

(56) References Cited

U.S. PATENT DOCUMENTS 2,797,149 A 6/1957 Skeggs (Continued)

FOREIGN PATENT DOCUMENTS

WO WO 88/04052 A1 6/1988
WO WO 97/21090 6/1997
WO WO 02/18949 A2 3/2002

OTHER PUBLICATIONS

U.S. Appl. No. 09/482,599, filed Jan. 13, 2000, Bower et al.

*Primary Examiner*—Brian Sines
(74) *Attorney, Agent, or Firm*—Todd J. Burns

(57) ABSTRACT

A method of transporting a desired fluid in a channel includes: providing a working fluid to transport the desired fluid, such as a sample; providing a first segment of a first buffer fluid which is immiscible with the working fluid and the desired fluid; providing a first segment of the desired fluid; providing a second segment of a second buffer fluid which is immiscible with the working fluid and the desired fluid; providing the desired fluid to be transported and further manipulated; and transporting the desired fluid in the channel by applying a motive force to the working fluid which in turn exerts force against the desired fluid through the first and second buffer fluid. The method prevents dilution of a sample in an apparatus such as a diagnostic analyzer or an apparatus for immunohematological testing of blood. A microfluidics handling system includes a microsystem platform that has: a substrate having: a first flat, planar surface; and a second flat planar surface opposite to the first surface. The first surface includes: at least one microchannel; an optional reagent source; an optional reaction chamber; a source of motive force to transport the fluid; a working fluid in the microchannels; a first segment of a first buffer fluid which is immiscible with the working fluid and the desired fluid; a first segment of the desired fluid; a second segment of a second buffer fluid which is immiscible with the working fluid and the desired fluid; and the desired fluid to be transported and further manipulated, wherein the fluid is present in the microchannels in the order of working fluid; first buffer fluid; first segment of the desired fluid, second buffer fluid; and the desired fluid.

6 Claims, 1 Drawing Sheet

U.S. PATENT DOCUMENTS 2,879,141 A 3/1959 Skeggs
3,479,141 A 11/1969 Smythe et al.
3,991,055 A * 11/1976 Godin et al. ..... 436/180
3,992,158 A 11/1976 Przybylowicz et al.
4,121,466 A * 10/1978 Reichler et al. ..... 73/864.22
4,259,291 A 3/1981 Smythe
4,526,754 A * 7/1985 Burns et al. ..... 422/82
4,574,850 A * 3/1986 Davis ..... 141/9
4,853,336 A 8/1989 Saros et al.
4,984,475 A * 1/1991 Uffenheimer et al. .... 73/864.22
5,399,497 A * 3/1995 Kumar et al. ..... 436/53
5,441,895 A 8/1995 Jakubowicz et al.
5,552,064 A 9/1996 Chachowski et al.
5,650,068 A 7/1997 Chachowski et al.
5,739,036 A * 4/1998 Parris ..... 436/53
5,992,820 A 11/1999 Fare et al.
6,096,561 A 8/2000 Tayi
6,453,928 B1 9/2002 Kaplan et al.
6,872,571 B1 * 3/2005 Adolfsen et al. ..... 436/53
7,077,152 B2 * 7/2006 Karp ..... 137/15.18

* cited by examiner

REDUCING WORKING FLUID DILUTION IN LIQUID SYSTEMS

BACKGROUND OF THE INVENTION

1. Field of the Invention

The present invention relates to transporting fluids in channels, such as conduits. In particular, the present invention relates to a method and apparatus for transporting fluids in channels and reducing contamination and/or dilution of fluid being transported.

2. Description of the Related Art

Fluid handling, for example, liquid handling in systems such as analyzers (chemical, biological and immunological), and blood typing systems (e.g., the Ortho ProVue™ system manufactured by Ortho-Clinical Diagnostics, Inc.) is known in the art. In addition, fluid handling in microfluidic systems as described in U.S. Pat. Nos. 6,453,928 and 5,992,820 and in PCT publication Nos. WO 97/21090 and WO 02/18949 is also known in the art. Fluid handling systems that use air to separate different liquid samples, or to identify or provide information for different samples are also known in the art. See, e.g., U.S. Pat. Nos. 4,853,336, 4,259,291, 3,479,141, 2,797,149 and 2,879,141. See also, WO 88/04052.

In fluid handling systems, it is generally known to use one fluid, hereinafter referred to as a working fluid (water, saline, etc.) to better control the fluid that is being handled, such as being aspirated or dispensed, by hydraulically coupling the metering pump motion to the fluid being metered. The working fluid helps ensure that the fluid being transported will be moved in a manner that-mimics the motion of the metering pump. Air based systems or systems with part air and part working fluid are subject to the compressibility of the air; thus metering precision and accuracy may be degraded.

A disadvantage with systems filled with working fluid only is that the fluid in the system can either dilute the fluid being metered or interact chemically with that fluid. The mixing of these fluids can occur because of turbulence, diffusion at the interface, and residual boundary layer fluid on the internal walls. It is generally known to use air gaps to separate fluids being transported. The size of the air gap is generally minimized such that the increased compressibility associated with the air ideally is not so large that the handling precision and accuracy is degraded substantially. The air gap or bubble can perform the function of "scrubbing" the internal walls of residual fluid, along with providing physical separation between the two fluids.

Several factors can result in increased mixing between these two fluids, even in the presence of an air gap, which reduces the effectiveness of the air gap and can result in unsatisfactory commingling of the two fluids. Some of these factors are listed below:

- Smoothness (conversely roughness) of the interior surface of the conduit where the fluid flows, since increased roughness will retain greater amounts of fluid.
- Changes in inner diameter of the conduit, such as a lumen since a change in internal diameter will induce turbulence.
- Surface wetability of the conduit surface.
- Control of the working fluid at the end of a probe on aspiration.
- Contact angle of the working fluid and fluid being transported to the channel surface.
- Rheology of the fluids being transported since high viscosity fluids will increase the size of the boundary layer.

Accordingly, no air gap or even a single air gap between the working fluid and fluid being handled is unsatisfactory for many applications, including clinical chemistry diagnostics, immunodiagnostics, blood screening, immunohematology, and microfluidics, where the effect of contamination with the working fluid can be significant.

SUMMARY OF THE INVENTION

One object of the invention is to overcome the disadvantages of the known art described above. Another object of the invention is to provide a method of manipulating a fluid that results in less, or preferably no contamination or undesired dilution of the fluid. Another object of the invention is to provide a system that can manipulate a fluid, such as transport or dispense a fluid that results in less, or preferably no contamination or undesired dilution of the fluid.

The foregoing and further objects of the invention are accomplished according to one aspect of the invention that provides a method of transporting a desired fluid in a channel that includes: providing a working fluid to transport the desired fluid; providing a first segment of a first buffer fluid which is immiscible with the working fluid and the desired fluid; providing a first segment of the desired fluid; providing a second segment of a second buffer fluid which is immiscible with the working fluid and the desired fluid; providing the desired fluid to be transported and further manipulated; and transporting the desired fluid in the channel by applying a motive force to the working fluid which in turn exerts force against the desired fluid through the first and second buffer fluid.

Another aspect of the invention provides a method of preventing or reducing contamination or dilution of a fluid being transported in a channel that includes: providing a working fluid to transport the desired fluid; providing a first segment of a first buffer fluid which is immiscible with the working fluid and the desired fluid; providing a first segment of the desired fluid; providing a second segment of a second buffer fluid which is immiscible with the working fluid and the desired fluid; and providing the desired fluid to be transported and further manipulated.

Another aspect of the invention provides a method of dispensing a fluid to be analyzed, that includes: providing a probe having a working fluid contained therein; aspirating a segment of a first buffer fluid which is immiscible with the working fluid and the desired fluid from a buffer fluid source into the probe; aspirating a segment of the fluid to be dispensed; aspirating a segment of a second buffer fluid which is immiscible with the working fluid and the desired fluid from a buffer fluid source into the probe after the segment of the fluid to be dispensed; aspirating a selected amount of the fluid to be dispensed; and dispensing the selected amount of fluid to be dispensed, wherein the segment of fluid to be dispensed located between the first and second buffer fluid is not dispensed.

Still another aspect of the invention provides an analyzer for analyzing a fluid sample containing an analyte that includes: a source of a fluid sample containing an analyte to be analyzed; a sample receiving element for receiving the fluid sample to be analyzed; and a detector for detecting the analyte contained in the fluid, a fluid handling system that includes a channel to transport the sample, wherein the fluid handling systems includes a working fluid in the channel; a first segment of a first buffer fluid which is immiscible with the working fluid and the sample; a first segment of the sample; a second segment of a second buffer fluid which is immiscible with the working fluid and the sample; and the sample to be transported and analyzed, wherein the fluid is present in the channels in the order of working fluid; first buffer fluid; first segment of the fluid sample, second buffer fluid; and the sample which will be analyzed.

Yet another aspect of the invention provides an apparatus for immunohematological testing of blood that includes: a sample and reagent metering system; a gel test card containing multiple microtubes having a gel for agglutinating red blood cells contained in the sample; an incubator for incubating one or more gels cards; a centrifuge for centrifuging one or more gel cards; and an image recorder and processor for recording an image of the test card and processing the results to determine one or more of the following: agglutination strength of weak to strong (0+, 1+, 2+, 3+, 4+), empty gel card, double cell population; excess red cells and no results determined, wherein the sample and reagent metering system includes a fluid handling system that includes a channel to transport the sample or reagents, wherein the fluid handling systems includes a working fluid in the channel; a first segment of a first buffer fluid which is immiscible with the working fluid and the sample; a first segment of the sample or reagent; a second segment of a second buffer fluid which is immiscible with the working fluid and the sample or reagent; and the sample or reagent to be transported and analyzed, and wherein the fluid is present in the channels in the order of working fluid; first buffer fluid; first segment of the fluid sample or reagent, second buffer fluid; and the sample or reagent which will be analyzed.

Yet another aspect of the invention provides a microfluidics handling system including: a microsystem platform that includes: a substrate having: a first flat, planar surface; and a second flat planar surface opposite to the first surface. The first surface has: at least one microchannel; an optional reagent source; an optional reaction chamber; a source of motive force to transport the fluid; a working fluid in the microchannels; a first segment of a first buffer fluid which is immiscible with the working fluid and the desired fluid; a first segment of the desired fluid; a second segment of a second buffer fluid which is immiscible with the working fluid and the desired fluid; and the desired fluid to be transported and further manipulated, wherein the fluid is present in the microchannels in the order of working fluid; first buffer fluid; first segment of the desired fluid, second buffer fluid; and the desired fluid.

Further objects, features and advantages of the present invention will be apparent to those skilled in the art from detailed consideration of the preferred embodiments that follow.

BRIEF DESCRIPTION OF THE DRAWINGS

FIG. 1*a* shows a schematic view of a fluid handling system that includes a working fluid and fluid being handled with no air gap in between.

FIG. 1*b* shows a schematic view of a fluid handling system that includes a working fluid and fluid being handled with a single air gap in between.

DETAILED DESCRIPTION OF PREFERRED EMBODIMENTS

Figure 1A:
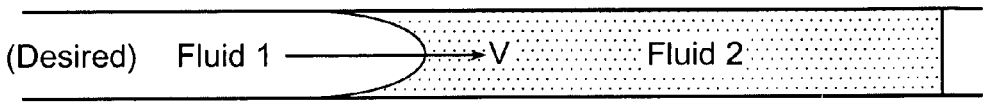

In fluid handling systems having a walled channel, e.g., a conduit, fluid flow speed profile is not uniform in the walled channel; instead, the center has the highest speed. The working fluid will always mix with the desired fluid (e.g., reagent or sample) if no separation between the two is made. This depends to a large extent on their respective solubilities. Although a large "dead volume" of desired fluid can be aspirated to avoid contaminating the desired fluid by the working fluid, some contamination will always occur due to the zero velocity of fluid on the solid wall. A general practice has been to use a single bubble to separate the working fluid from the desired fluid. This technique can help reduce the contamination between the two different fluids. But avoiding contamination by a single bubble is compromised by the fact that fluid tends to coat the channel surface as it passes the channel in the liquid-air interface. The present inventors have found that by introducing a second air bubble, the liquid between the two bubbles serves as a diluent for the contaminants left by the preceding fluid. The concentration of liquid between the two bubbles is significantly lower than the working fluid. Therefore the contamination of the desired fluid is significantly reduced.

Accordingly, the present invention is directed to reducing or preferably eliminating dilution or contamination of a fluid being handled or acted upon and used in further operations (hereinafter called the "desired fluid") by a fluid that is present in the channels of the system (hereinafter called the "working fluid"), to give better control over the handling (e.g., transport or dispensing) of the desired fluid since the compressibility is lower than with a system such as air. However, as noted above, using systems with a working fluid, with or without air between the working system, continues to result in problems of contamination and dilution of the desired fluid.

The present inventors have found that incorporating a further segment of air (or any other non-reactive immiscible fluid), results in dilution and/or contamination of the desired fluid by the working fluid being reduced and/or eliminated. This is particularly true in microfluidics handling. In a preferred embodiment of the invention after the working fluid is in place, an air bubble is aspirated into the system. A selected amount of the desired fluid is then aspirated, followed by another air bubble. The desired fluid that is actually intended to be dispensed is then aspirated. Two bubbles and a layer of the same material (albeit diluted) that is going to be metered now separate the desired fluid that is being metered from the working fluid. Any contamination of the desired fluid being metered by the working fluid is therefore reduced by an order of magnitude. In this embodiment the fluid being dispensed makes contact with a bubble that makes contact with potentially diluted aliquot of the same fluid that is again separated by a bubble from the working fluid.

Along these same lines, the present invention also includes other embodiments of adding additional separator segments of buffer fluid (e.g., air) and desired fluid as needed to get the proper amount of separation. A major advantage is that two bubbles provide for four fluid interfaces instead of two, with each fluid-air interface having the ability to reduce the boundary layer surface film. This results in better carry-in control with small volumes of total air in the system and enabling a system to function acceptably with deficiencies in the mechanical design. That is, use of the present invention can provide required separation between working fluid and desired fluid in systems where geometric and size considerations would prohibit the use of large dead spaces of desired fluid. This can be important since small channel size is essential for micro-fluidics and it also reduces carry-in or the dilution effect. "Desired fluid" and "working fluid" have been defined as above. The desired fluid can include any fluid that will be subjected to further operations, such as analysis. For example, the desired fluid can include blood or any other body fluid that will be analyzed for the presence of an analyte. As used herein "analyte" is any molecule or molecules that are to be detected and/or quantified in a sample. Preferred analytes include biomolecules such as nucleic acids, antibodies, proteins, sugars, and the like. As used herein "blood" broadly includes whole blood or any component of whole blood, such as red blood cells, plasma, serum, etc.

The working fluid is incorporated into a channel of an apparatus, such as an analyzer or microfluidic handling system. The working fluid can be a fluid that is replaced often, such as with every use, or is more permanent and may be replaced only periodically or even never. The working fluid can include fluids such as saline, water, inert oil such as silicone oil, heptane, etc.

As used herein, "channel" refers to a path that directs fluid flow in a particular direction. The channel can be formed as a groove or trench having a bottom and sides, or as a fully enclosed tube or conduit. The channel can have virtually any cross-section, e.g., circular, square, rectangular, triangular, V-shaped, U-shaped, hexagonal, octagonal, irregular, and so forth. The channel can have any convenient configuration including, but not limited to, linear, curved, serpentine (e.g., a linear portion joined by a curve or loop to another linear portion, which is itself joined by a curve or loop to a third linear branch). The channel may have abrupt changes, e.g., step-wise changes in diameter, such as due to different tubing being joined. For example, if plastic tubing is fitted onto the outside diameter of a metal tube, the transition will abruptly transition from the larger diameter of the plastic tubing to the smaller diameter of the metal tube. The term "microchannel" is used herein in microfluidics embodiments for a channel having a characteristic dimension of about 100 μm or less.

Located between the working fluid and desired fluid is the first and second buffer fluid. The first buffer fluid will be positioned between the working fluid and a first segment of the desired fluid. Positioned between the first segment of the desired fluid and a further segment of the desired fluid is the second buffer fluid. The first and second buffer fluid can be the same or different. A requirement of the buffer fluid is that it be immiscible with the desired fluid and the working fluid. As used herein, the term "immiscible" refers to the absence of substantial mixing between two different fluids. Thus, a first fluid is immiscible in a second when the two fluids are maintained separate fluid phases under the conditions used. In a preferred embodiment of the invention, the buffer fluids are a gas, such as air, or relatively inert gas under standard conditions, such as nitrogen, argon, carbon dioxide, helium In a preferred embodiments all of the buffer fluids are the same and are air. Other buffer fluids that can be used include silicone oil and/or heptane and as noted above, in some embodiments, more than two segments of buffer fluid may be used. In those instances, a third, fourth, etc. of buffer fluid/desired fluid segments may be used.

A motive force is provided for moving the fluids through the channel. The motive force can be provided by any suitable device. For example, for systems such as clinical analyzers or blood typing systems, a conventional pumping system or an aspirating dispensing probe, etc. can be used.

For microfluidic systems, smaller amounts of fluid are moved. In such instances the motive force can be supplied by centripetal action such as described in WO 97/21090 or electrode based pumping such as described in U.S. Pat. No. 5,992,820, both of which are incorporated herein by reference in their entireties.

The desired fluid which has been manipulated or transported will generally be used in another operation, such as being dispensed onto a test element to be analyzed, or into gel blood typing cards, such as the MTS ID-Micro Typing System™ gel cards. Such cards contain microtubes containing a gel for agglutinating red blood cells present in a sample. Further description can be found in U.S. Pat. Nos. 5,650,068 and 5,552,064 both of which are incorporated herein by reference in their entireties. As used herein, a "test element" means any reaction vessel in which at least one reagent has been supplied, for example so-called dried slide test elements such as are described in, e.g., U.S. Pat. No. 3,992,158; or a cup or well having a cavity pre-coated with one or more anti-bodies, such as is described in U.S. Pat. No. 5,441,895, or an uncoated cavity to which reagent is added. In a preferred embodiment the system is a clinical analyzer and after the desired fluid has been dispensed into the test element, the test element will be further incubated, additional reagents add can be added, and the test element can be read using a spectrophotomer. A particularly preferred use for the present invention is in an automated instrument for immunohematological testing of blood, such as the MTS ProVue® described above. A preferred instrument includes: a sample and reagent metering system that includes the fluid handling system of the present invention, one or more gel test cards, such as the MTS ID-Micro Typing System®; an incubator for incubating one or more gels cards; a centrifuge for centrifuging one or more gel cards; and an image recorder and processor for recording an image of the test card and processing the results to determine one or more of the following agglutination strength of weak to strong (0+, 1+, 2+, 3+, 4+), empty gel card, double cell population, excess red cells and no results determined. The image recorder and processor can be those well known in the art and would typically include a camera for recording the image of the card, a memory for storing the image and a microprocessor for analyzing the image.

The present invention is also particularly useful in microfluidics or fluid micromanipulation. Such systems are described in publications such as WO 97/21090 described above. In microfluidic systems, preferred micro channels include, but are not limited to, tubes, grooves, channels formed by opposed barriers, and the like.

In a preferred microfluidic device, the channel is a groove formed in the surface of a substrate, and the device includes a cover element that overlies and seals the channel. In a variation of this embodiment, the cover element is removably attached to the substrate.

Particularly preferred channel/cover element/projecting member materials include, but are not limited to, glass, silicon, quartz or other minerals, plastic(s), ceramics, metals, paper, metalloids, semiconductive materials, cements, and the like. In addition, substances that form gels, such as proteins (e.g., gelatins), lipopolysaccharides, silicates, agarose and polyacrylamides can be used. A wide variety of organic and inorganic polymers, both natural and synthetic, can be employed as channel materials. Illustrative polymers include polyethylene, polypropylene, poly(4-methylbutene), polystyrene, polymethacrylate, poly(ethylene terephthalate), rayon, nylon, poly(vinyl butyrate), polyvinylidene difluoride (PVDF), polydimethylsiloxane (PDMS), silicones, polyformaldehyde, cellulose, cellulose acetate, nitrocellulose, and the like.

Polymeric channel materials can be rigid, semi-rigid, or non-rigid, opaque, semi-opaque, or transparent depending upon the use for which they are intended. For example, devices that include all optical or visual detection element are generally fabricated, at least in part, from transparent materials to allow or at least facilitate that detection. Alternatively, transparent windows of, e.g., glass or quartz can be incorporated into the device. Additionally, the polymeric materials may have linear or branched backbones and may be crosslinked or noncrosslinked. Examples of particularly preferred polymeric materials include, e.g., polydimethylsiloxane (PDMS), polyurethane, polyvinylchloride (VPC), polystyrene, polysulfone, polycarbonate, and the like. As described above, the channel in this embodiment is a component of a microfluidic device. Methods of fabricating the channels used in the microfluidic aspect of the invention are well known to those of skill in the art. For example, where the channels are fabricated on a surface, they can be formed using standard techniques, e.g., they can be machined, molded, carved, etched, laminated, extruded, or deposited, etc. Such methods are more fully described in WO 02/18949.

The buffer fluid can be incorporated into the system in any know manner. For example, in a clinical analyzer, the buffer fluid, which would generally be air, can be aspirated into the system through the metering probe from the surrounding air. For microfluidic embodiments, electrode induced bubbles may be used, as described in U.S. Pat. No. 5,992,820 described above.

In some systems, it may be possible to add additional buffer fluids such as silicone oil between each desired and/or working fluid segments. One example of two buffer fluids between two desired fluid segments include air and silicone oil as described in U.S. Pat. No. 3,479,141. This has the advantage of preventing a so-called "softening" of the system due to a gas being the buffer fluid. However, because of the increased likelihood of dilution, it is generally preferred to have only a single buffer fluid (preferably a gas) between each desired and/or working fluid segments.

Figure 1B:
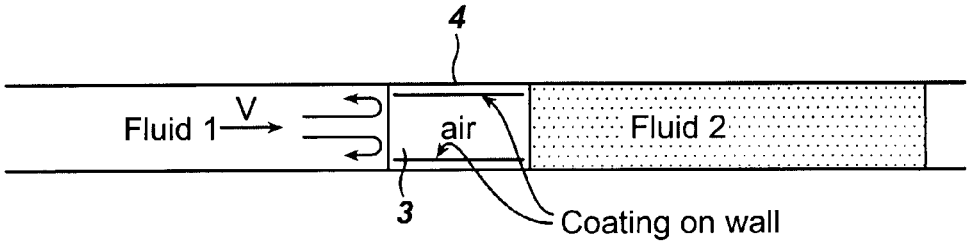
Figure 1C:
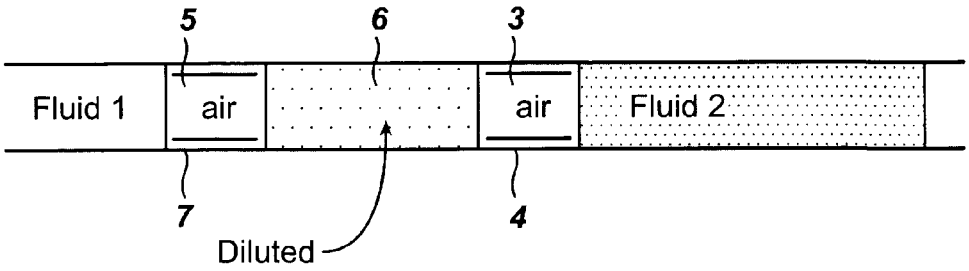
FIG. 1*c* shows a schematic view of a fluid handling system that includes a working fluid and fluid being handled with a double air gap in between according to a preferred embodiment of the present invention.

FIG. 1*a* shows a system that does not include a buffer fluid between the working fluid (2) and the desired fluid (1). In this instance, unless the working fluid and desired fluid are immiscible, there will be considerable dilution of the desired fluid for a significant length of the channel. FIG. 1*b* shows a single air bubble (3), where the working fluid is retained in a residual boundary layer (4) with the channel sidewalls. In this instance, considerable dilution of the desired fluid (1) results due to this residual working fluid in the air bubble (3). FIG. 1*c* shows an embodiment of the present invention. In this embodiment, a first air bubble (3) is introduced, followed by a first segment (6) of the desired fluid. After the first segment of desired fluid, another air bubble (5) is introduced, followed by the desired fluid (1). The first air bubble (3) contains the working fluid retained at the boundary layer (4) as in FIG. 1*b*, resulting in considerable dilution of the segment of desired fluid (6). However, the presence of the second air bubble (5) results in a further boundary layer (7) of desired fluid that is significantly less diluted with working fluid than the boundary layer in the first air bubble (3). As a result the desired fluid (1) further dispensed or further manipulated will be significantly less diluted with working fluid.

Another aspect of the invention provides an analyzer that aspirates and dispenses sample to be analyzed and/or reagents using the method described. The analyzer includes a sample reservoir, optionally a reagent reservoir, a fluid handling system that can transport and dispense a sample and/or reagents, optionally an incubator and a detector, such as a spectrophotometer. The fluid handling system is preferably an aspirating/dispensing probe that includes a disposable tip. The sample, reagent and buffer fluid, preferably air, enter the fluid handling system through the probe tip. Typical analyzers, such as immunoassay analyzer systems, can be found in U.S. Pat. No. 6,096,561 and U.S. application Ser. No. 09/482,599 filed Jan. 13, 2000 entitled "Failure Detection in Automatic Clinical Analyzers," both of which are incorporated herein by reference in their entireties.

It will be apparent to those skilled in the art that various modifications and variations can be made to the compounds, compositions and processes of this invention. Thus, it is intended that the present invention cover such modifications and variations, provided they come within the scope of the appended claims and their equivalents.

The disclosure of all publications cited above are expressly incorporated herein by reference in their entireties to the same extent as if each were incorporated by reference individually.

We claim:

1. A method of dispensing a fluid to be analyzed, comprising:

providing a probe having a working fluid contained therein;

aspirating a segment of a first buffer fluid which is immiscible with the working fluid and the desired fluid from a buffer fluid source into the probe;

aspirating a segment of the fluid to be dispensed;

aspirating a segment of a second buffer fluid which is immiscible with the working fluid and the desired fluid from a buffer fluid source into the probe after the segment of the fluid to be dispensed;

aspirating a selected amount of the fluid to be dispensed; and dispensing the selected amount of fluid to be dispensed, wherein the segment of fluid to be dispensed located between the first and second buffer fluid is not dispensed.

2. A method as claimed in claim 1, wherein the first and second buffer fluid are the same.

3. A method as claimed in claim 2, wherein the first and second buffer fluid comprise air.

4. A method as claimed in claim 1, wherein the desired fluid contains an analyte to be analyzed.

5. A method as claimed in claim 1, wherein the desired fluid contains blood to be typed.

6. A method as claimed in claim 1, wherein the working fluid comprises silicone oil.

* * * * *